United States Patent [19]

Beisswenger et al.

[11] 4,444,568

[45] Apr. 24, 1984

[54] METHOD OF PRODUCING FUEL GAS AND PROCESS HEAT FRON CARBONACEOUS MATERIALS

[75] Inventors: Hans Beisswenger, Bad Soden; Georg Daradimos, Maintal; Martin Hirsch, Friedrichsdorf; Ludolf Plass, Kronberg; Harry Serbent, Hanau, all of Fed. Rep. of Germany

[73] Assignee: Metallgesellschaft, Aktiengesellschaft, Frankfurt, Fed. Rep. of Germany

[21] Appl. No.: 362,266

[22] Filed: Mar. 26, 1982

[30] Foreign Application Priority Data

Apr. 7, 1981 [DE] Fed. Rep. of Germany ..... 3113993

[51] Int. Cl.[3] ..... C10J 3/54

[52] U.S. Cl. ..... 48/197 R; 48/206

[58] Field of Search ..... 48/197 R, 203, 202, 48/206; 110/347; 122/4 D

[56] References Cited

U.S. PATENT DOCUMENTS

| | | | |
|---|---|---|---|
| 3,807,090 | 4/1974 | Moss | 122/4 D |
| 4,026,679 | 5/1977 | Collin | 48/197 R |
| 4,069,304 | 1/1978 | Starkovich et al. | 48/202 |
| 4,085,707 | 4/1978 | Moss | 110/347 |
| 4,111,158 | 9/1978 | Reh et al. | 122/4 D |
| 4,165,717 | 8/1979 | Reh et al. | 122/4 D |
| 4,347,064 | 8/1982 | Reh et al. | 48/203 |

OTHER PUBLICATIONS

Trends in Process Technology, Processing Nov. 1980, p. 23.

*Primary Examiner*—Peter F. Kratz

*Attorney, Agent, or Firm*—Felfe & Lynch

[57] ABSTRACT

In a process of simultaneously producing fuel gas and process heat from carbonaceous materials wherein the carbonaceous materials are gasified in a first fluidized bed stage and the combustible constituents left after the gasification are subsequently burnt in a second fluidized bed stage the throughput rate and the flexibility are increased in that the gasification is carried out at a pressure of up to 5 bars and a temperature of 800° to 1100° C. by a treatment with oxygen-containing gases in the presence of steam in a circulating fluidized bed and 40 to 80% of the carbon contained in the starting material are thus reacted. Sulfur compounds are removed from the resulting gas in a fluidized state at a temperature in the range from 800° to 1000° C. and the gas is then cooled and subjected to dust collection. The gasification residue together with the by-products which have become available in the purification of the gas, such as laden desulfurizing agent, dust and aqueous condensate, are fed to another circulating fluidized bed and the remaining combustible constituents are burnt there with an oxygen excess of 5 to 40%.

13 Claims, 1 Drawing Figure

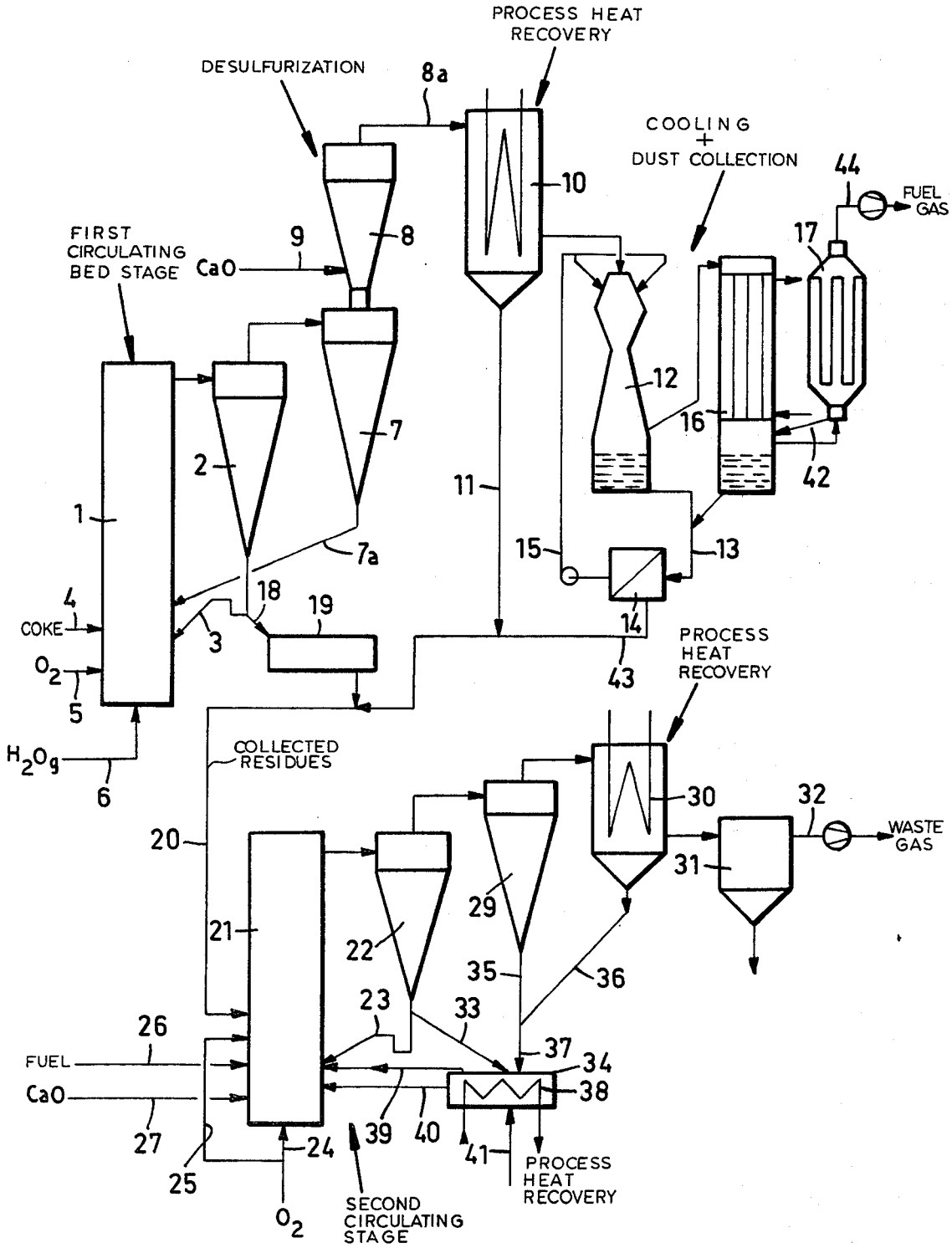
PROCESS HEAT RECOVERY
DESULFURIZATION
8a
COOLING + DUST COLLECTION
44
FUEL GAS
10
FIRST CIRCULATING BED STAGE
9
CaO
8
17
12
16
7
2
42
11
1
7a
15
13
4
18
19
14
COKE
3
43
PROCESS HEAT RECOVERY
$O_2$
5
$H_2O_g$
6
COLLECTED RESIDUES
30
32
WASTE GAS
20
31
29
21
22
35
36
23
33
26
37
FUEL
34
CaO
38
27
39
40
24
41
PROCESS HEAT RECOVERY
25
$O_2$
SECOND CIRCULATING STAGE

METHOD OF PRODUCING FUEL GAS AND PROCESS HEAT FRON CARBONACEOUS MATERIALS

FIELD OF THE INVENTION

This invention relates to a process for simultaneously producing fuel gas and process heat from carbonaceous materials and, more particularly, to a process utilizing fluidized bed principles for gasifying such materials, e.g. coal.

BACKGROUND OF THE INVENTION

Energy in various forms is required in industrial production and is often produced from high-grade carriers of primary energy, such as gas and oil. The increasing shortages and the growing political insecurity of the supply increasingly require that these energy carriers be substituted by solid fuels. For this reason, new technologies are needed for a transformation of the solid fuels into a form in which they can be substituted for the traditional energy carriers in existing processes.

The pollution involved in the use of solid fuels must be reliably avoided, particularly because the shortage of primary energy necessitates an increasing use of coals having high ash and sulfur contents.

In dependence on the nature of a given process step carried out to produce a given product, energy is needed by industry in various forms, for instance, as heating steam, as high-temperature heat in a different form, or as a clean fuel gas, which can be burned without adversely affecting the quality of the product.

While energy in various forms, such as fuel gas and steam, can be produced separately, the capital requirements and operating expenses involved in that practice are not justified in industrial plants of usual size. Besides, an operation of independent plants for the conversion of energy involves high losses and an increased expenditure for the protection of the environment.

In order to avoid the disadvantages involved in the separate production of energy in different forms, a process for the simultaneous production of fuel gas and steam has been proposed, in which coal of any desired quality is gasified in a fluidized bed and the gasification residue is burned to produce steam (Processing, November 1980, page 23).

This process is an advance in a promising direction although its throughput rate related to given reactor dimensions is low and owing to the process conditions selected, particularly for the gasifying stage, the flexibility regarding the relative rates at which fuel gas and steam can be produced is low. Besides, this process does not provide a solution to the problems encountered in the required purification of fuel gas, particularly as regards the removal of sulfur and of the noxious by-products formed by the purification of fuel gas.

OBJECTS OF THE INVENTION

It is the principal object of the invention to provide a method of and an apparatus for the simultaneous production of a fuel gas and process heat from a carbonaceous material whereby the disadvantages of earlier systems are avoided.

Another object of this invention is to provide a process for obtaining fuel and heat from a carbonaceous material, especially coal, which maximizes the amounts of fuel and heat which can be obtained and yet affords the advantages of high flexibility with respect to the form in which the energy is obtained.

Another object of this invention is to provide an improved process for the purposes described and in which the carbonaceous material used as the starting material can be of a high-sulfur type.

SUMMARY OF THE INVENTION

We have now found, quite surprisingly, that earlier fluidized bed principles for the gasification of carbonaceous materials, especially coal, can be improved upon by carefully controlling the operations of two distinct fluidized bed stages, each of which is operated as a circulating fluidized bed, i.e. a circulating fluidized bed in which the solid phase is not only fluidized by a fluidizing gas but the solids of the bed are continuously entrained out of the bed separated from the gas phase outside the fluidized bed reactor and at least in part recycled to the fluidized bed.

When both of the fluidized bed stages are part of circulating fluidized bed systems and carbonaceous materials are gasified in the first fluidized bed stage while combustible components from this first fluidized bed stage are recovered and burned in the second circulating fluidized bed stage, it is possible to regulate the desulfurization process and the balance between fuel gas production and process heat production so that all of the disadvantages which have previously been described can be obviated.

While the specific operating parameters of the two stages are vital to the present invention and will be discussed in some detail below, a brief review of the most critical parameters is important.

Firstly, we have discovered, the gasification must be carried out at a pressure ranging from ambient up to 5 bars at a temperature of 800° C. to 1100° C. by reacting the carbonaceous materials with oxygen-containing gases in the presence of steam in the first circulating fluidized bed, with the parameters of the latter being adjusted such that 40% to 80% of the carbon of the starting material is reacted in this first fluidized bed.

We have also found it to be critical to the present invention, both from the point of view of eliminating environmental hazards, and of effective operation as will be described hereinafter, to remove sulfur compounds from the gases of the first circulating fluidized bed stage by the direct contact of entrained sulfur-trapping solids with these gases at a temperature in the range of 800° C. to 1000° C. so that this contact, although not necessarily a fluidized bed interaction, is a solids/gas contact in a fluidized state, i.e. a stage in which the particles move freely in the gas.

Another critical aspect of the invention is that the gasification residues (preferably all of these residues including any particulates separated from the gas after gasification, any solids recovered for desulfurization and solids recovered after the gas has been cooled and subjected to dust collection or removal) are fed to the second circulating fluidized bed stage where the residual combustibles are burned with an oxygen excess of 5% to 40% above the stoichiometric level required for such combustion to yield carbon dioxide.

It may be noted that, with the present invention, the gases are not materially cool following particulate removal after gasification and before being contacted with the sulfur-removing solids, but that cooling of the gases follows separation of the solids from the gases subsequent to the desulfurization treatment whereupon the cooled gases can be subjected to conventional dust collection operations.

Thus, the process of the invention requires that:

(a) the gasification is carried out at a pressure of up to 5 bars and at a temperature of 800° C. to 1100° C. by a treatment with oxygen-containing gases in the presence of steam in a circulating fluidized bed and 40% to 80% of the carbon contained in the starting material are thus reacted;

(b) sulfur compounds are removed from the resulting gas in a fluidized state at a temperature in the range from 800° C. to 1000° C. and the gas is then cooled and subjected to dust collection; and (c) the gasification residue together with the by-products which have become available in the purification of the gas, such as laden desulfurizing agent, dust and aqueous condensate, are fed to another circulating fluidized bed and the remaining combustible constituents are burned there with an oxygen excess of 5% to 40%.

The process according to the invention can be used with all carbonaceous materials which can be gasified and burned in a thermally self-sustaining process. It is particularly attractive for all kinds of coal, particularly for low-grade coal, such as washery refuse, slurry coal, and coal having a high salt content. Brown coal and oil shale can be processed too.

A circulating fluidized bed used in the gasifying and combustion stages differs from the orthodox fluidized bed in that it involves states of distribution without a defined boundary layer whereas in the orthodox fluidized bed a dense phase is separated by a distinct change in density from the overlying gas space. In a circulating fluidized bed there is no sudden change in density between the dense phase and an overlying gas space but the solids concentration in the reactor decreases continuously from bottom to top.

The following ranges will be obtained if the operating conditions are defined by means of the Froude number and Archimedes number:

$$0.1 \leqq \tfrac{3}{4} \times F_r^2 \times \frac{\rho_g}{\rho_k - \rho_g} \leqq 10$$

$$0.01 \leqq Ar \leqq 100$$

where $$Ar = \frac{d_k^3 \times g(\rho_k - \rho_g)}{\rho_g \times \nu^2} \text{ and}$$

$$F_r^2 = \frac{u^2}{g \times d_k}$$

and u=relative gas velocity in m/sec
Ar=Archimedes number
$F_r$=Froude number
$\rho_g$=density of gas in kg/m$^3$
$\rho k$=density of solid particle in kg/m$^3$
$d_k$=diameter of spherical particle in m
$\nu$=kinematic viscosity in m$^2$/sec
g=constant of gravitation The gas which is produced can be desulfurized in any desired state of fluidization, for instance in a venturi fluidized bed from which solids are discharged into a succeeding separator, although a circulating fluidized bed may be used advantageously even for the desulfurization.

According to a particularly preferred feature of the invention, 40% to 60% by weight of the carbon contained in the starting material are reacted in the gasifying stage. In that case a fuel gas having a particularly high calorific value can be produced and it is not necessary to use steam, which in the succeeding stages forms aqueous condensate, at the high rates otherwise required.

Unless the carbonaceous material contains moisture for producing steam at the rate required for the gasification, steam must be added for the gasifying reaction. The steam and the oxygen-containing gas required should be fed on different levels.

According to a further preferred feature of the invention, the gasifying stage is fed with steam mainly in the form of fluidizing gas and with oxygen-containing gas mainly in the form of secondary gas.

However, the steam at a low rate may be fed together with the oxygen-containing secondary gas and oxygen-containing gas at a low rate may be fed together with the steam used as fluidizing gas.

It will also be desirable to provide for a residence time of the gases of 1 to 5 seconds in the gasifying stage above the inlet for the carbonaceous material. This requirement is usually met in that the carbonaceous material is charged on a higher level into the gasifying stage. This practice will result in a gas which contains more volatilized products so that it has a higher calorific value and which reliably contains no hydrocarbons having more than 6 carbon atoms.

The usual desulfurizing agents may be used to desulfurize the gas. According to a further preferred feature, the gases leaving the gasifying stage are desulfurized in a circulating fluidized bed by a treatment with lime (CaO) or dolomite or the corresponding calcined products having a particle diameter of $d_p50$=30 to 200 $\mu$m and for this purpose the fluidized bed reactor is operated to maintain therein a suspension having a mean solids density of 0.1 to 10 kg/m$^3$, preferably 1 to 5 kg/m$^3$, and to circulate solids through said reactor at such a rate that the weight of the solids circulated through the fluidized bed per hour is at least 5 times the weight of the solids contained in the reactor shaft.

Under these conditions the desulfurization can be effected at high gas rates and at a highly constant temperature. The high temperature constancy is desirable for the desulfurization in that the desulfurizing agent retains its activity and its capacity to take up sulfur. This advantage is supplemented by the small particle size of the desulfurizing agent because the ratio of surface area to volume is particularly favorable for a combination of sulfur at a high rate, which depends particularly on the diffusion velocity.

The desulfurizing agent should be supplied at a rate which is at least 1.2 to 2.0 times the rate which is stoichiometrically required in accordance with formula:

$$CaO + H_2S = CaS + H_2O$$

Where dolomite or calcined dolomite is used, it should be borne in mind that virtually only the calcium component will react with the sulfur compounds.

Desulfurizing agent is preferably charged into the fluidized bed reactor by one or more lances, e.g. by pneumatic injection.

Particularly favorable operating conditions will be obtained if a gas velocity of 4 to 8 meters per second (calculated as empty-pipe velocity) is maintained during the desulfurization.

Particularly if the exhaust gases of the gasifying stage exit at high temperatures, it will be desirable, according to a preferred embodiment of the invention, to charge all desulfurizing agent, also that required for the combustion stage, to the gas-desulfurizing stage. In that case the heat energy required to heat and, if desired, to deacidify, the desulfurizing agent is extracted from the gas and is thus retained in the combustion stage.

The combustible constituents which have not been reacted in the gasifying stage are burned in the second circulating fluidized bed, in the presence of the by-products that have become available as a result of the purification of the gas and which thus are eliminated in an ecologically satisfactory manner. The laden desulfurizing agents leaving the gas-purifying stage, particularly if they consist of sulfides, such as calcium sulfide, are sulfatized and thus transformed into compounds which can be dumped, such as calcium sulfate. Besides, the heat of reaction liberated during the sulfatization is recovered as process heat. The other by-products, such as the collected dust and aqueous condensate, are also removed.

The term process heat is used to describe a heat-carrying fluid which contains energy that can be used in various ways to carry out a process. Said fluid may consist of a heating gas or of an oxygen-containing gas which may be used in the operation of various kinds of fuel-burning equipment. It will be particularly advantageous to produce saturated steam or superheated steam, which may also be used for heating, e.g. to heat a reactor, or may be used to drive electric generators or to heat heat-carrying salts, e.g. for heating tube reactors or autoclaves.

According to a preferred feature of the invention the combustion is carried out in two stages with the aid of oxygen-containing gases fed on different levels. This practice affords the advantage that combustion is "soft" so that hot spots will be avoided and a formation of $NO_x$ will be substantially suppressed. In the two-stage combustion the upper inlet for oxygen-containing gas should be sufficiently spaced above the lower inlet so that the oxygen content of the gas fed through the lower inlet has been substantially consumed at the upper inlet.

If steam is desired as process heat, a preferred further feature of the invention resides in the fact that the rates of fluidizing and secondary gases are controlled to maintain a suspension having a mean solids density of 15 to 100 kg/m$^3$ above the upper gas inlet and at least a substantial part of the heat generated by the combustion is dissipated through cooling surfaces provided within the free space of the reactor above the upper gas inlet.

Such an operation has been described more in detail in German Patent Publication No. 25 39 546 and in the corresponding U.S. Pat. No. 4,165,717.

The gas velocities in the fluidized bed reactor above the secondary gas inlet are usually above 5 meters per second under normal pressure and may be as high as 15 meters per second. The ratio of the diameter to the height of the fluidized bed reactor should be selected so that the gas has a residence time of 0.5 to 8.0 seconds, preferably 1 to 4 seconds.

The fluidizing gas may consist of virtually any gas that will not adversely affect the properties of the exhaust gas. For instance, inert gases may be used, such as recycled flue gas (exhaust gas), nitrogen and steam. In order to intensify the combustion process, the fluidizing gas consists preferably of oxygen-containing gas.

There are the following options:

1. The fluidizing gas consists of an inert gas. In that case the oxygen-containing combustion gas used as secondary gas must be fed on at least two vertically spaced apart levels.

2. The fluidizing gas consists of oxygen-containing gas. In that case the secondary gas may be fed on one level only although the secondary gas may also be fed on a plurality of levels too, of course.

The secondary gas is desirably fed through a plurality of inlet openings on each level.

This practice will afford the advantage that the rate at which process heat is recovered can be varied in a very simple manner by a change of the solids density of the suspension in the fluidized bed reactor above the inlet for secondary gas.

Given operating conditions determined by given volumetric flow rates of the fluidizing gas and secondary gas resulting in a given mean solids density of the suspension will be accompanied by a certain heat transfer rate. The rate of heat transfer to the cooling surfaces will be increased if the solids density of the suspension is increased by an increase of the rate of fluidizing gas and, if desired, the rate of secondary gas. At a virtually constant combustion temperature, a higher heat transfer rate will permit a dissipation of the heat which will be generated at a higher rate if the combustion rate has been increased. In that case, the higher oxygen requirement which is due to the higher combustion rate will be automatically met because the fluidizing gas and, if desired, the secondary gas is supplied at a higher rate in order to increase the solids density of the suspension.

On the other hand, if less process heat is required the combustion rate can be reduced in that the solids density of the suspension in the fluidized bed reactor above the secondary gas inlet is controlled accordingly. The decrease of the solids density of the suspension will decrease the heat transfer rate so that less heat is supplied by the fluidized bed reactor. In this way the combustion rate can be decreased substantially without a change in temperature.

The carbonaceous material is also suitably fed through one or more lances, e.g. by pneumatic injection.

Another preferred feature of the combustion process is more universally applicable and resides in that the rates of fluidizing gas and secondary gas are controlled to maintain above the upper gas inlet a mean solids density of the suspension of 10 to 40 kg/m$^3$, hot solids are withdrawn from the circulating fluidized bed and are cooled by direct and indirect heat exchange in a fluidized state, and at least one partial stream of cooled solids is recycled to the circulating fluidized bed.

This embodiment utilizes principles discussed in open German application No. 26 24 302 and in the corresponding U.S. Pat. No. 4,111,158.

In this embodiment of the invention, the temperature can be maintained constant virtually without a change of the operating conditions in the fluidized bed reactor, e.g. without a change of the solids density of the suspension, only by a controlled recycling of the cooled solids. The recycle rate will depend on the combustion rate and the selected combustion temperature. The combustion temperature may be selected as desired between very low temperatures, which are only slightly above the ignition threshold, and very high temperatures, which may be limited by a softening of the combustion residues. The combustion temperature may lie in the range of 450° C. and 950° C.

Since most of the heat generated by the combustion of the combustible constituents is withdrawn in the fluidized bed cooler, which receives the solids from the fluidized bed reactor, the heat transfer to cooling registers in the fluidized bed reactor requiring sufficiently high solids density of the suspension is of minor importance. For this reason another advantage afforded by this process resides in that a high solids density of the suspension in the fluidized bed reactor above the secondary gas inlet is not required so that the pressure loss throughout the fluidized bed reactor will be relatively low. On the other hand, heat is extracted in the fluidized bed cooler under such conditions that an extremely high heat transfer rate, e.g. in a range of 400 to 500 watts/$m^2$°C., is effected.

To control the combustion temperature in the reactor, at least one partial stream of cooled solids is recycled from the fluidized bed cooler. For instance, the required partial current of cooled solids may be charged directly into the fluidized bed reactor.

In addition, the exhaust gas may be cooled by an introduction of cooled solids, which may be fed, e.g. to a pneumatic conveyor or a suspension type heat exchanger stage. The solids are subsequently separated from the exhaust gas and recycled to the fluidized bed cooler, so that the exhaust gas heat is also supplied to the fluidized bed cooler. It will be particularly desirable to charge one partial stream of cooled solids directly into the fluidized bed reactor and to charge another partial stream of cooled solids indirectly to the fluidized bed reactor after said other partial stream has been used to cool the exhaust gases.

In this embodiment of the invention, too, the residence times and velocities of the gases above the secondary gas inlet under normal pressure and the kind at which fluidizing and secondary gases are supplied are selected in accordance with the corresponding conditions used in the embodiment described before.

The recooling of the hot solids from the fluidized bed reactor should be effected in a fluidized bed cooler which has a plurality of cooling chambers which contain interconnected cooling registers and in which the hot solids flow in a countercurrent to the coolant. In this way the heat generated by the combustion can be absorbed by a relatively small quantity of coolant.

The universal usefulness of the embodiment described last resides particularly in that almost any desired heat-carrying fluid can be heated in the fluidized bed cooler. Of special technological significance is the production of steam in various forms and the heating of heat-carrying salts.

The flexibility of the process according to the invention will be further increased if, in accordance with another preferred feature of the invention, additional carbonaceous materials are charged to the combustion stage. This embodiment will afford the advantage that the production of process heat in the combustion stage can be increased as desired without a change of the production of fuel gas in the gasifying stage.

The oxygen-containing gases used in the process according to the invention may consist of air or oxygen-enriched air or commercially pure oxygen. Particularly in the gasifying stage it is desirable to use a gas which contains as much oxygen as possible. The performance in the combustion stage can be increased if the combustion is carried out under superatmospheric pressure, up to about 20 bars.

The fluidized bed reactors used in carrying out the process according to the invention may be rectangular or square or circular in cross section. The lower portion of the fluidized bed reactor may be conical; this will be particularly advantageous with reactors which are large in cross section so that high gas throughput rates can be employed.

BRIEF DESCRIPTION OF THE DRAWING

The invention will be explained in detail with reference to the accompanying drawing, the sole FIGURE of which is a flow diagram representing the process according to the invention.

SPECIFIC DESCRIPTION

A circulating fluidized bed contained in the fluidized bed reactor 1, a cyclone separator 2 and a recycle duct 3 is supplied through duct 4 with carbonaceous material, which is gasified in the bed by a treatment with oxygen fed through a secondary gas duct 5 and with steam fed through a fluidizing gas duct 6.

Dust is collected from the resulting gas in a second cyclone separator 7 and the gas is then fed to a venturi reactor 8, which is supplied with desulfurizing agent through duct 9.

The desulfurizing agent and the gas are jointly fed by line 8a to a waste heat boiler 10, where the desulfurizing agent is collected and withdrawn through a duct 11.

The gas enters a scrubber 12, in which residual dust is collected. The liquid absorbent is circulated by a pump through a conduit 13, a filter 14 and another conduit 15.

The gas finally enters a condenser 16, in which water is eliminated, and flows then through a wet-process electrostatic precipitator 17 before being discharged through duct 44.

The residue left after the gasification is withdrawn through duct 18 from the circulating fluidized bed 1, 2, 3 and is fed through a cooler 19 and a duct 20 to the second circulating fluidized bed, which is contained in a fluidized bed reactor 21, a cyclone separator 22 and a recycle duct 23.

Oxygen-containing gas used as fluidizing gas and secondary gas is fed through ducts 24 and 25, respectively. Additional fuel can be fed through duct 26 and desulfurizing agent through duct 27.

Desulfurizing agent, sludge and aqueous condensate are conducted in ducts 11 and 42 and conduit 43, respectively, and fed through duct 20 together with the gasification residue. The gas leaving the separator 22 following the fluidized bed reactor 21 is freed from dust in another cyclone separator 29 and is then cooled in a waste heat boiler 30. Additional ash is collected from the waste gas in the separator 31. The exhaust gas is finally discharged through duct 32.

A partial stream of the solids circulating through the fluidized bed reactor 21, separting cyclone 22 and recycle duct 23 is withdrawn from the latter through duct 33 and is cooled in the fluidized bed cooler 34. The latter is also fed through ducts 35, 36 and 37 with the dust which has been collected in the separating cyclone 29 and the waste heat boiler 30.

The coolant consists of a heat-carrying salt, which is conducted through the fluidized bed cooler 34 in cooling registers 38 in countercurrent to the solids. The oxygen-containing fluidizing gas is fed through duct 41 to the fluidized bed cooler 34 and is heated there and is then fed through duct 39 as secondary gas to the fluidized bed reactor 21. Recooled solids are fed through duct 40 to the fluidized bed reactor 21 in order to absorb heat of combustion.

SPECIFIC EXAMPLES

Example 1

The coal used contained:
20% by weight ash and
8% by weight moisture
and had a calorific value of 25.1 MJ/kg (MJ=Megajoule)

At a rate of 3300 kg/h, this coal was charged through duct 4 to the fluidized bed reactor 1, which was simultaneously fed through duct 5 with 913 $m^3$ (S.T.P.) per hour oxygen-containing gas which contained 95% by volume $O_2$ and through duct 6 with 280 kg/h steam at 400° C. Under the selected operating conditions, a temperature of 1020° C. and a mean solids density of the suspension of 200 kg/$m^3$ reactor volume (measured above conduit 5) were obtained in the fluidized bed reactor 1.

The gas, which had been substantially freed from solids in the cyclone separator 2, was fed at a temperature of 1020° C. to the cyclone separator 7, where additional dust was collected. The gas was then fed to a venturi fluidized bed 9 to which 238 kg/h lime containing 95% by weight $CaCO_3$ were charged.

Together with the laden desulfurizing agent the desulfurized gas was discharged at a temperature of 920° C. and fed to the waste heat boiler 10, in which 155 kg/h laden desulfurizing agent were collected and 1.75 metric tons/h saturated steam of 45 bars were produced. The gas which had been freed from dust and cooled then entered the scrubber 12 and was purified therein by means of an liquid circulated by a pump through conduit 13, filter 14 and conduit 15.

The gas was then fed to the condenser 16 and was indirectly cooled there to 35° C. The gas was subsequently passed through a wet-process electrostatic precipitator 17 and was finally discharged through duct 44 as 3940 $m^3$ (S.T.P.)/h fuel having a calorific value of 10.6 MJ/$m^3$ (S.T.P.).

Gasification residue was withdrawn through duct 18 from the circulating fluidized bed used for gasification and together with the laden desulfurizing agent withdrawn through duct 11 and filter cake withdrawn through duct 43 was fed to the fluidized bed reactor 21 through duct 20. The total feed rate was 1869 kg/h. The fluidized bed reactor 21 was also fed through the fluidizing gas duct 24 with 3400 $m^3$ (S.T.P.)/h air and through secondary gas duct 25 with 4900 $m^3$ (S.T.P.)/h air.

Additional secondary gas at a rate of 1900 $m^3$ (S.T.P.)/h was fed through duct 39 and consisted of air that had been heated in the fluidized bed cooler 34. The last-mentioned air stream had a temperature of 500° C. In the fluidized bed reactor 21, a combustion temperature of 850° C. and above the uppermost secondary gas inlet a mean solids density of the suspension of 30 kg/$m^3$ were maintained. The exhaust gas from the fluidized bed reactor was fed to the recycle cyclone 22 and was freed therein from entrained solids and was then fed to the cyclone separator 29, in which dust was collected. The gas was finally fed to the waste heat boiler 30, where the exhaust gas was cooled from 850° C. to 140° C. and 3.6 metric tons/h superheated steam at 45 bars and 480° C. were produced.

The gas was subsequently fed to the separator 31, in which additional ash was collected. Finally the gas was fed at a temperature of 140° C. through duct 32 to the chimney. 660 kg/h ash and 247 kg/h sulfatized desulfurizing agent were collected in the separator 31. The ash rate of 660 kg/h accounted for all ash formed in the combustion stage.

From the solids circulating in the circulating fluidized bed in 21, 22, 23, 45 metric tons/h were withdrawn through duct 33 and fed to the fluidized bed cooler 34 and were cooled in the latter by means of a heat-carrying salt, which was conducted in a countercurrent and fed at 350° C. and at a rate of 185 metric tons/h. In the cooler 34, the heat-carrying salt was heated to 420° C. and the ash was cooled to 400° C. The ash was then recycled through duct 40 to the fluidized bed reactor 21 in order to absorb heat generated by the combustion therein.

The fluidized bed cooler 34 had four separate cooling chambers and was supplied with fluidizing gas consisting of 1900 $m^3$ (S.T.P.)/h air, which was heated to provide a mixture at 500° C. As mentioned above, the heated air was supplied through duct 39 to the fluidized bed reactor 21 as secondary gas.

In the example just described, the energy which was recovered was distributed as follows:
Fuel gas: 55.9%
Steam: 19.5%
Heat-carrying salt: 24.6%

Example 2

A coal was used which contained also
20% by weight ash and
8% by weight moisture
and had a calorific value of 25.1 MJ/kg.

At a rate of 3300 kg/h, this coal was charged through duct 4 to the fluidized bed reactor 1, which was simultaneously fed through duct 5 with 776 $m^3$ (S.T.P.) per hour oxygen-containing gas which contained 95% by volume $O_2$ and through duct 6 with 132 kg/h steam at 400° C.

Under the selected operating conditions, a temperature of 1000° C. and a mean solids density of the suspension of 200 kg/$m^3$ reactor volume (measured above conduit 5) were obtained in the fluidized bed reactor 1. The gas which had substantially been freed from solids in the cyclone separator 2 was fed at a temperature of 1000° C. to the cyclone separator 7, where additional dust was collected.

The gas was then fed to a venturi fluidized bed 9, to which 238 kg/h lime containing 95% by weight $CaCO_3$ were charged. Together with the laden desulfurizing agent the desulfurized gas was discharged at a temperature of 900° C. and fed to the waste heat boiler 10, in which 155 kg/h laden desulfurizing agent were collected and 1.52 metric tons/h saturated steam of 45 bars were produced. The gas which had been freed from dust and cooled then entered the scrubber 12 and was purified therein by means of an liquid circulated by a pump through conduit 13, filter 14 and conduit 15.

The gas was then fed to the condenser 16 and was indirectly cooled there to 35° C. The gas was subsequently passed through a wet-process electrostatic precipitator 17 and was finally discharged through duct 44 as 3400 $m^3$ (S.T.P.)/h fuel having a calorific value of 10.6 MJ/$m^3$ (S.T.P.).

Gasification residue was withdrawn through duct 18 from the circulating fluidized bed used for gasification and together with the laden desulfurizing agent withdrawn through duct 11 and filter cake withdrawn through duct 43 was fed to the fluidized bed reactor 21 through duct 20. The total feed rate was 2068 kg/h.

The fluidized bed reactor 21 was also fed through the fluidizing gas duct 24 with 3075 $m^3$ (S.T.P.)/h air and through secondary gas duct 25 with 7325 $m^3$ (S.T.P.)/h air. Additional secondary gas at a rate of 1900 $m^3$ (S.T.P.) was fed through duct 39 and consisted of air that had been heated in the fluidized bed cooler 34. The last-mentioned air stream had a temperature of 500° C.

In the fluidized bed reactor 21, a combustion temperature of 850° C. and above the uppermost secondary gas inlet a mean solids density of the suspension of 30 kg/$m^3$ were maintained.

The exhaust gas from the fluidized bed reactor 21 was fed to the recycle cyclone 22 and was freed therein from entrained solids and was then fed to the cyclone separator 29, in which dust was collected.

The gas was next fed to the waste heat boiler 30, where the exhaust gas was cooled from 850° C. to 140° C. and 4.4 metric tons/h superheated steam at 45 bars and 480° C. were produced. The gas was subsequently fed to the separator 31, in which additional ash was collected.

Finally the gas was fed at a temperature of 140° C. through duct 32 to the chimney. 660 kg/h ash and 247 kg/h sulfatized desulfurizing agent were collected in the separator 31. The ash rate of 660 kg/h accounted for all ash formed in the combustion stage.

From the solids circulating in the circulating fluidized bed in 21, 22, 23, 54 metric tons/h were withdrawn through duct 33 and fed to the fluidized bed cooler 34 and were cooled in the latter by means of a heat-carrying salt, which was conducted in a countercurrent and fed at 350° C. and at a rate of 223 metric tons/h. In the cooler 34, the heat-carrying salt was heated to 420° C. and the ash was cooled to 400° C. The ash was then recycled through duct 40 to the fluidized bed reactor 21 in order to absorb heat generated by the combustion therein.

The fluidized bed cooler 34 had four separate cooling chambers and was supplied with fluidizing gas consisting of 1900 $m^3$ (S.T.P.)/h air, which was heated to provide a mixture at 500° C. As mentioned above, the heated air was supplied through duct 39 to the fluidized bed reactor 21 as secondary gas.

In the example just described, the energy which was recovered was distributed as follows:

Fuel gas: 48.1%
Steam: 22.3%
Heat-carrying salt: 29.6%

Example 3

Example 2 was modified in that additional coal was burned in the combustion stage to produce more energy therein whereas the conditions in the gasifying stage were not changed.

For this purpose the fluidized bed reactor 21 was charged through duct 26 with 500 kg/h additional coal having the properties stated hereinbefore and through duct 27 with 35 kg/h limestone (95% by weight $CaCO_3$). Fluidizing air at a rate of 4100 $m^3$ (S.T.P.)/h was fed through duct 24 and secondary air at a arate of 10,300 $m^3$ (S.T.P.)/h through duct 25.

Owing to the changed conditions compared with Example 2, 5.7 metric tons/h steam at 45 bars and 480° C. were produced in the waste heat boiler 30 and 302 metric tons/h heat-carrying salt were heated from 350° C. to 420° C. in the cooler 34. For this purpose, the solids quantity passed through the fluidized bed cooler 34 had to be increased to an amount of 73 metric tons/h. 760 kg/h ash and 284 kg/h sulfatized desulfurizing agent were collected.

The energy recovered from the entire quantity of coal which had been fed was distributed as follows:

Fuel gas: 41.1%
Steam: 24.4%
Heat-carrying salt: 34.5%

We claim:

1. A method of generating a fuel gas and process heat from a carbonaceous material which comprises:

(a) reacting said carbonaceous material with oxygen-containing gases in the presence of steam in a circulating fluidized bed of a fluidized bed reactor at a temperature of 800° C. to 1100° C. in a first fluidized bed stage in which solids are entrained by gases from the fluidized bed, separating the entrained solids from the gas phase and recycling at least a portion of the separated solids to the fluidized bed to react 40 to 80% of the carbon contained in said material and produce a fuel gas therefrom contained in said gas phase;

(b) contacting thereafter said gas phase at a temperature of 800° C. to 1000° C. with particles of a sulfur-trapping solid which are fluidized in said gas phase thereby removing sulfur therefrom;

(c) recovering sulfur-trapping particles from the gas phase following step (b);

(d) cooling the gas phase following the recovery of the sulfur-trapping particles therefrom and subjecting the cooled gas phase to at least one dust collection step to obtain said fuel gas and collect dust from the cooled gas phase; and (e) feeding solids withdrawn from said first circulating fluidized bed stage, the dust collected in step (d), the particles recovered in step (c), and aqueous condensate, to a second circulating fluidized bed stage and burning combustible constituents therein with an oxygen excess of 5 to 40% to produce a waste gas which is discharged to the atmosphere after process heat recovery.

2. The method defined in claim 1 wherein 40 to 60% by weight of the carbon contained in the starting material are reacted in step (a).

3. The method defined in claim 1 wherein the fluidized bed of step (a) is fed with steam at least primarily in the form of fluidizing gas and with oxygen-containing gas at least primarily in the form of secondary gas (5).

4. The method according to claim 1, wherein the fluidized bed has an inlet and a residence time of 1 to 5 seconds of the gas is maintained in the fluidized bed of step (a) above the inlet for the carbonaceous material.

5. The method defined in claim 1 wherein the gases leaving the gasifying stage of step (a) are desulfurized in a fluidized bed reactor by a treatment with lime or dolomite or the corresponding calcined products having a particle diameter of $d_p50=30$ to 200 $\mu$m and for this purpose the fluidized bed reactor is operated to maintain therein a suspension having a mean solids density of 0.1 to 10 kg/$m^3$ and solids are passed through said reactor at such a rate that the weight of the solids passed through the fluidized bed per hour is at least 5 times the weight of the solids contained in the reactor shaft.

6. The method defined in claim 5 wherein said reactor is part of a circulating fluidized bed stage and the mean solids density in said reactor is 1 to 5 kg/m$^3$.

7. The method defined in claim 1 wherein a gas velocity of 4 to 8 meters per second, calculated as empty-pipe velocity, is maintained during the desulfurization in step (b).

8. The method defined in claim 1 wherein all of the desulfurizing agent, including the sulfur-trapping solid of step (b) and any required for the combustion stage of step (e), is fed to step (b).

9. The method defined in claim 1 wherein the combustion of step (e) is effected in two stages with the aid of oxygen-containing gases fed at different levels.

10. The method defined in claim 9 wherein in step (e) fluidizing and secondary gases are supplied and the rates thereof controlled to maintain a suspension having a mean solids density of 15 to 100 kg/m$^3$ above the upper gas inlet and at least a substantial part of the heat generated by the combustion is dissipated through cooling surfaces provided within the free space of the fluidized bed above the upper gas inlet.

11. The method defined in claim 9 wherein in step (e) fluidizing gas and secondary gas are supplied and the rates thereof controlled to maintain above an upper gas inlet a mean solids density of the suspension of 10 to 40 kg/m$^3$, hot solids are withdrawn from the circulating fluidized bed and are cooled by direct and indirect heat exchange in a fluidized state, and at least one partial stream of cooled solids is recycled to the circulating fluidized bed of step (e).

12. The method defined in claim 1 wherein additional carbonaceous materials are fed to the combustion stage of step (e).

13. A method according to claim 1, wherein a portion of the solids are recovered in a recirculating cyclone and a second portion of solids is recovered in subsequent stages, the latter recovered solids also being recycled into the fluidized bed of said second stage.

* * * * *